US006065607A

United States Patent [19]

Magnusson et al.

[11] Patent Number: 6,065,607

[45] Date of Patent: May 23, 2000

[54] GRADING MACHINE AND EQUIPMENT

[75] Inventors: Ragnar M. Magnusson, Gardabaer; Steinar Steinsson, Kopavogur; Egill Thor Ragnarsson, Seydisfjordur, all of Iceland

[73] Assignee: Style - R.M. Magnusson, Gardabaer, Iceland

[21] Appl. No.: 08/973,420

[22] PCT Filed: Jun. 10, 1996

[86] PCT No.: PCT/IS96/00004

§ 371 Date: Mar. 5, 1998

§ 102(e) Date: Mar. 5, 1998

[87] PCT Pub. No.: WO96/41541

PCT Pub. Date: Dec. 27, 1996

[30] Foreign Application Priority Data

Jun. 9, 1995 [IS] Iceland ..... 4255

[51] Int. Cl.[7] ..... B07B 13/05; B07C 5/06

[52] U.S. Cl. ..... 209/665; 209/622; 209/668

[58] Field of Search ..... 209/243, 247, 209/254, 659, 660, 665, 667, 668, 681, 622, 670

[56] References Cited

U.S. PATENT DOCUMENTS

| | | | |
|---|---|---|---|
| 1,178,006 | 4/1916 | Gehr . | |
| 1,204,685 | 11/1916 | Phillips . | |
| 1,251,093 | 12/1917 | Palmer . | |
| 1,373,812 | 4/1921 | Heath . | |
| 2,314,479 | 3/1943 | Christiansen . | |
| 2,547,473 | 4/1951 | Klem . | |
| 3,241,671 | 3/1966 | Brauchla | 209/243 |
| 4,723,660 | 2/1988 | Sjöberg | 209/622 |

FOREIGN PATENT DOCUMENTS

| | | |
|---|---|---|
| 2 435 973 | 4/1980 | France . |
| 132917 | 1/1974 | Norway . |
| 2 140 712 | 12/1984 | United Kingdom . |
| 88/06495 | 9/1988 | WIPO . |

*Primary Examiner*—Donald P. Walsh
*Assistant Examiner*—Brett C. Martin
*Attorney, Agent, or Firm*—Finnegan, Henderson, Farabow, Garrett & Dunner, L.L.P.

[57] ABSTRACT

The invention relates to a method and equipment for grading by thickness sensitive objects (particularly fish), large and small, involving gentle treatment of the objects, using ridge belts which are drawn by a drive along guides which are wider at the output end than at the intake end and covey the material gently without vibration or rubbing, together with infeed equipment.

9 Claims, 11 Drawing Sheets

GRADING MACHINE AND EQUIPMENT

Figure 1:
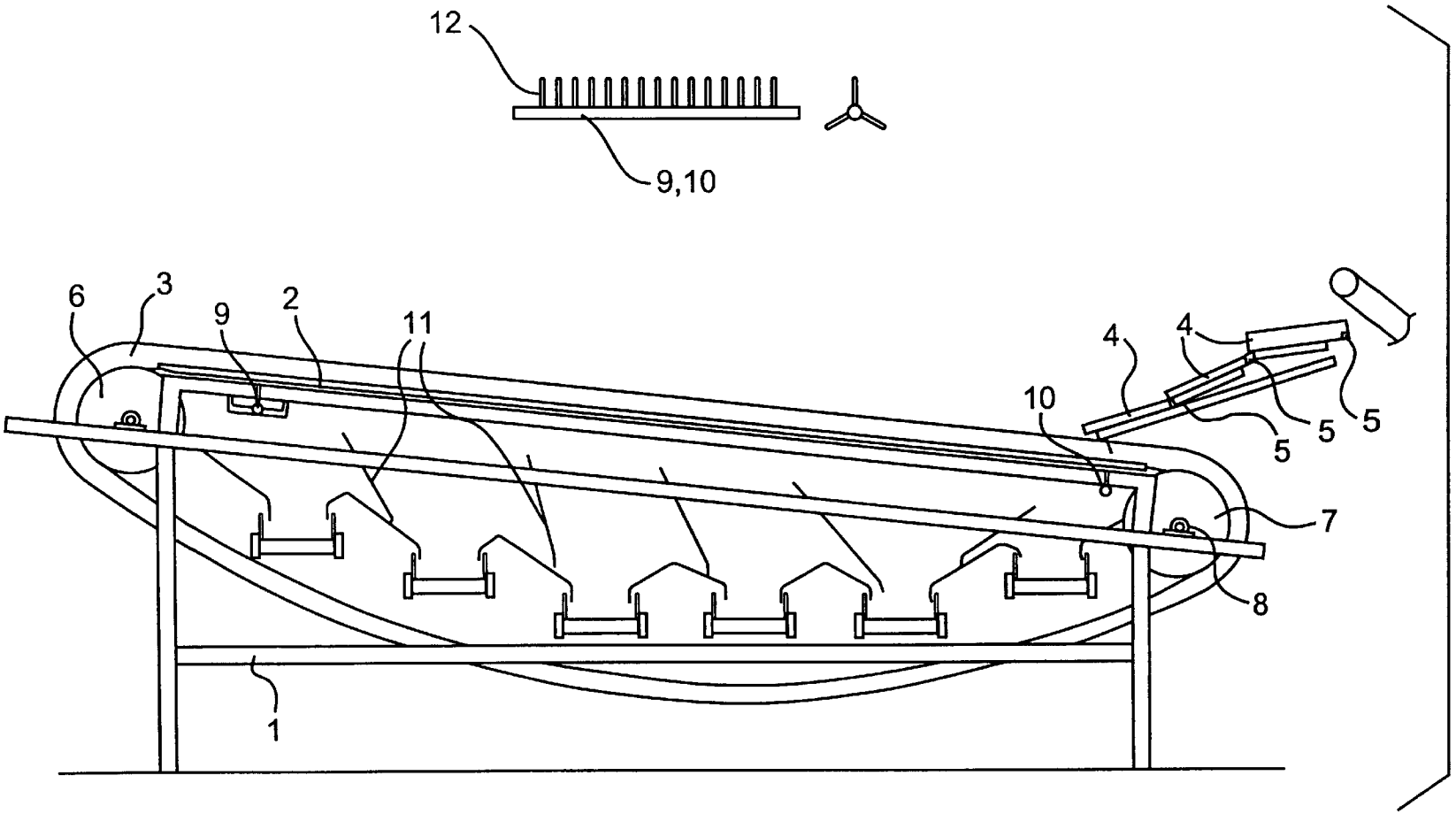

The invention concerns a method and equipment for grading according to thickness sensitive objects (particularly fish, but also other organic and non-organic materials), involving more gentle treatment of the objects, with a high processing rate.

The machinery and equipment involved is based on the assessment of the thickness of the objects, and is unique in that processing is based on specially-designed conveyor equipment (hereinafter called ridge-belts) which move the objects forwards without shaking them or rubbing their surface in the course of grading. The equipment includes special ridges, tracks, adjustment devices, drive equipment, infeed equipment and the co-ordination of the functioning of all these elements in order to achieve the desired aims.

Many types and versions of grading machine for fish and other materials are already known which grade the items according to an assessment of their thickness. These include machines with belts or rollers and shaker-graders with several grading channels. Like the ridge-belt machine, the aforementioned machines all have grading channels that are wider at the outlet than at the intake. The belt machine draws the objects forward between two inclined belts which form the channel, and if more channels are included in the same machine, each additional channel consists of an independent unit, i.e. another machine which is placed next to the first one. The roller machines include two rollers which turn, the items being moved relatively slowly past the rollers by means of friction between the rollers and the objects. In the case of a multi-channel grader, additional machine units are placed next to the first one. The shaker-grader consists of ridges which form gaps, the central ridges serving two channels as in the ridge-belt machine, but the objects are moved forward by being shaken, which throws the objects up at the same time as the ridges are moved under the items, which gradually moves them down across the grading frame. In addition to the aforementioned grading machines, there are machines which operate in accordance with different principles and are fitted with electronic scales or imaging sensors. The aim in presenting the ridge-belt machine is to present a machine which treats the items to be graded gently, is accurate, requires little maintenance and may be constructed so as to handle extremely large quantities. The machine takes the form of a conveyor belt which neither shakes the objects nor rubs them in the course of moving them, but moves them gently forward until the point where the gap becomes large enough for the object to fall through it.

The machine consists of a certain variable number of belts which are fitted with grading ridges, between which the grading gaps are formed. When grading is carried out in more than one size category, the gaps are kept narrower at the intake end of the machine that at the output end. By use of special adjustment equipment it is possible to widen or narrow the grading gaps both at the intake end and at the output end. The drive equipment which drives the grading ridges is specially designed so that it is possible to incline the tracks of the machine and make the gaps of varying sizes; in the case of the outermost tracks there is a high degree of inclination when the machine is equipped with a large number of grading gaps.

The infeed equipment ensures a high quality of grading, together with gentle treatment of the objects, while maximizing the utilization of the machine. To achieve this, the infeed equipment of the machine is designed so that the objects are in the optimal position before entering the machine, and the speed of the infeed to the grading gaps is similar to the speed on the grading ridges.

Through the interaction of adjustment devices, drive equipment, belts and ridges, it is possible to arrange the infeed to a machine which grades accurately into many size-ranges according to thickness. The machine can easily be set for objects in different size ranges, and it is easy to adjust the infeed equipment to the speed of the grader to ensure that the quality of the grading is not diminished by a high processing rate.

The ridge belts run along guides which are formed by the ridge control equipment. The ridges on the belts have sloping sides which direct the objects to the edges of the grader. Both sides of each ridge belt are used in the grading, since there is one grading gap on either side of each belt; thus, the number of belts is only one greater than the number of grading gaps.

Here follows a detailed description of the invention with reference to the figures, which are as follows:

FIG. 1. A side view of the equipment designed for the grading of smaller fish species and relatively light objects.

Figure 2:
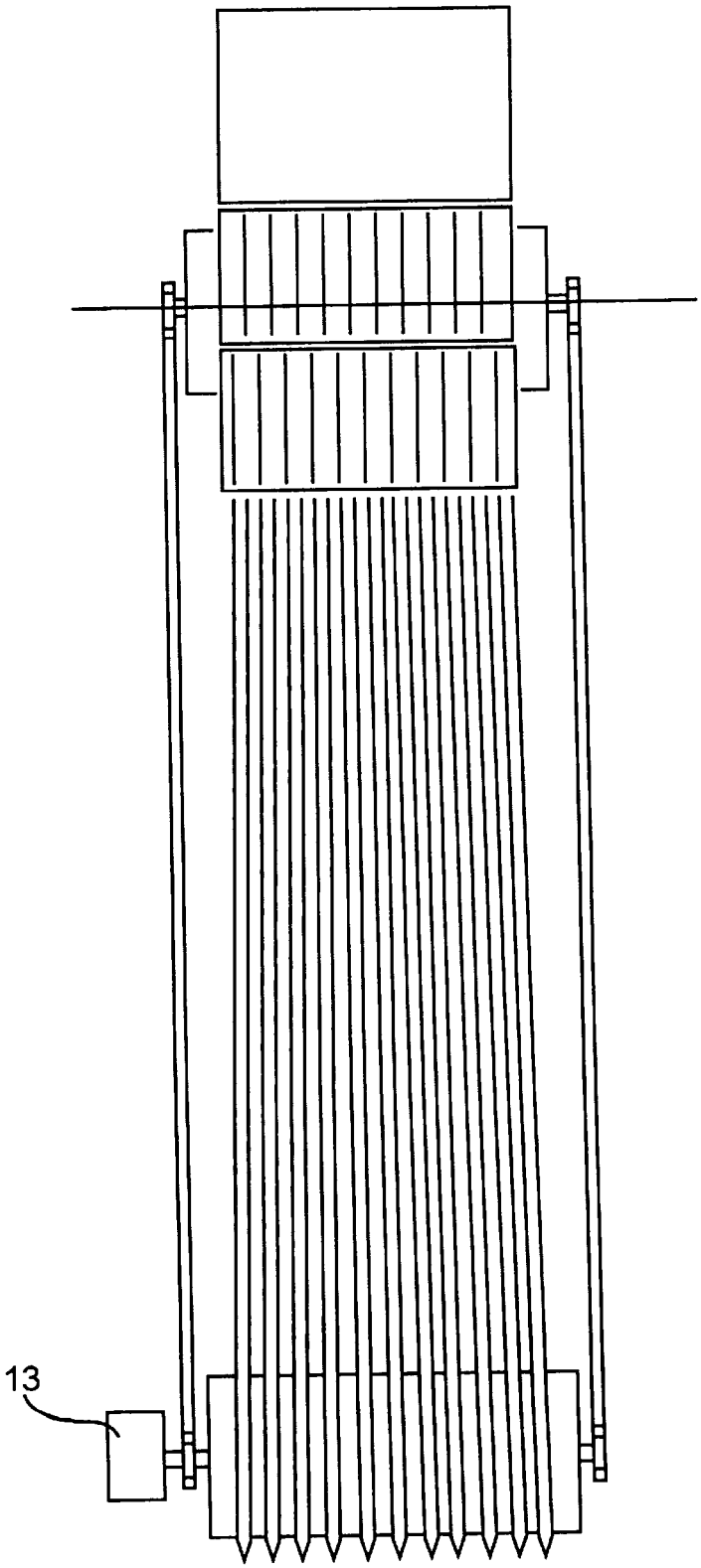

FIG. 2. Top view of the same equipment as No. 1.

Figure 3:
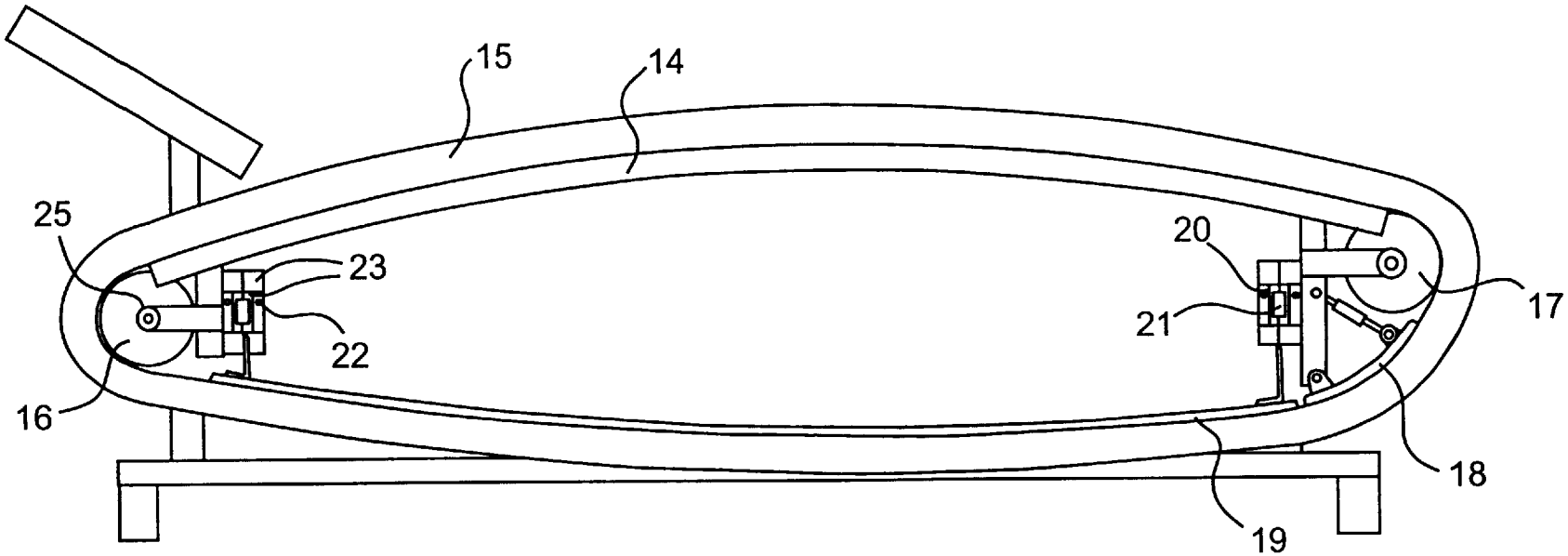

FIG. 3. A side view of the equipment designed for the grading of larger fish species or relatively heavy objects.

Figure 4:
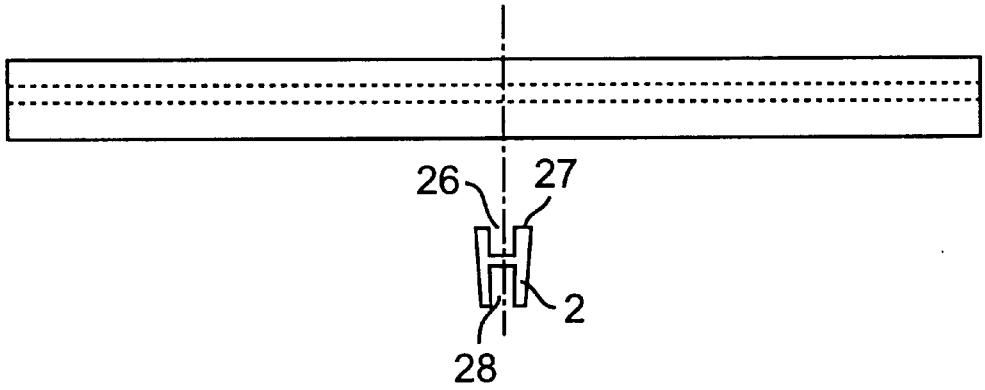

FIG. 4. Showing the ridge-belt guides for smaller fish and relatively light objects.

Figure 5:
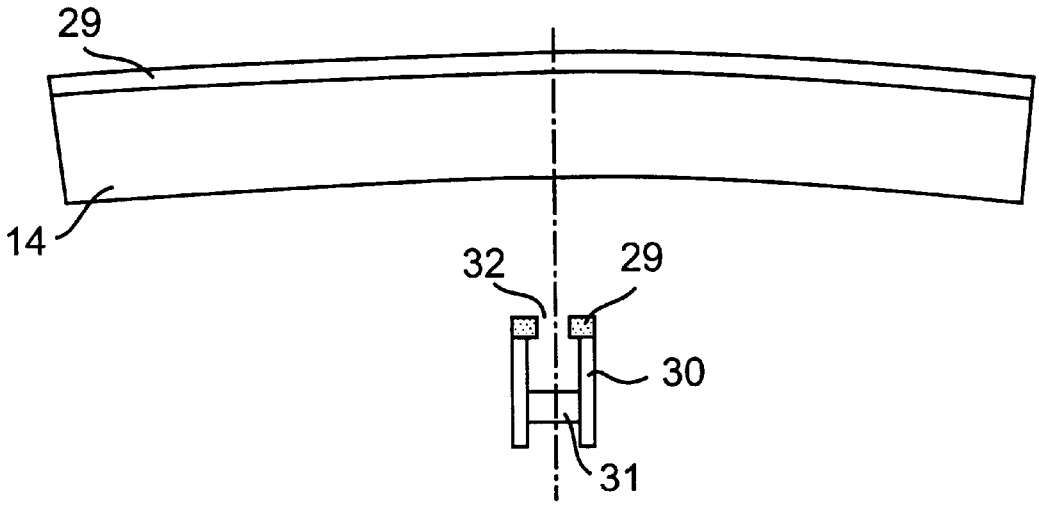

FIG. 5. Showing the ridge-belts guides for larger fish species or relatively heavy objects.

Figure 6:
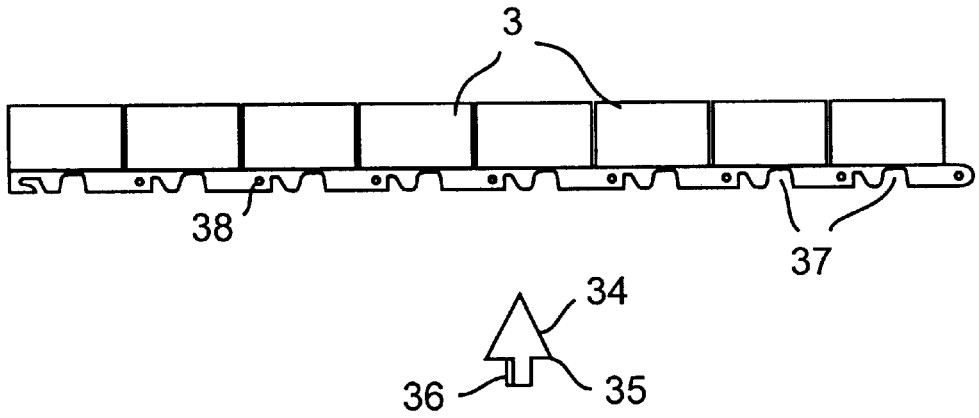

FIG. 6. Showing a ridge-belt for a light-construction machine for grading small fish species and relatively light objects.

Figure 7:
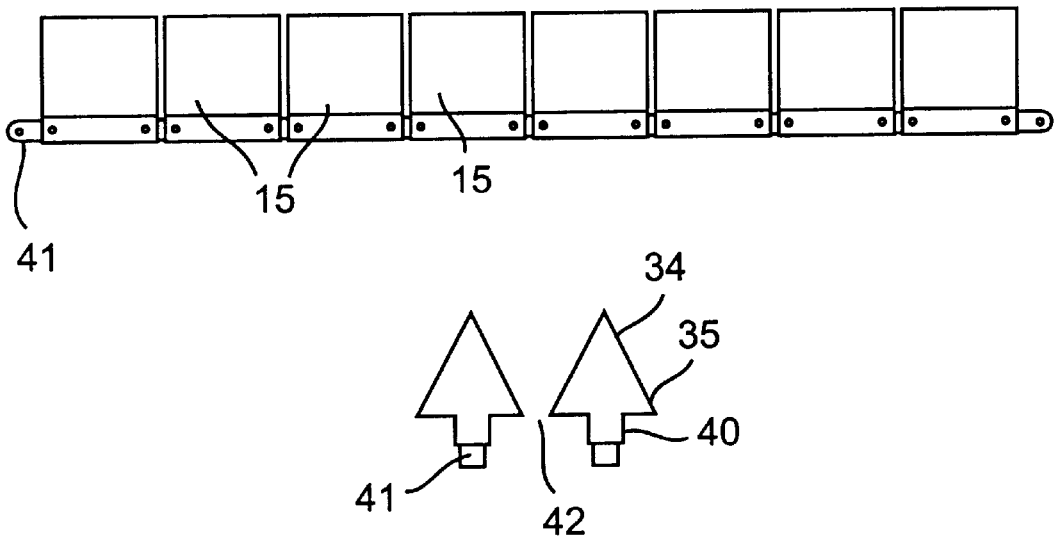

FIG. 7. Showing a ridge-belt for a heavy-construction machine for grading large fish species and relatively heavy objects.

Figure 8:
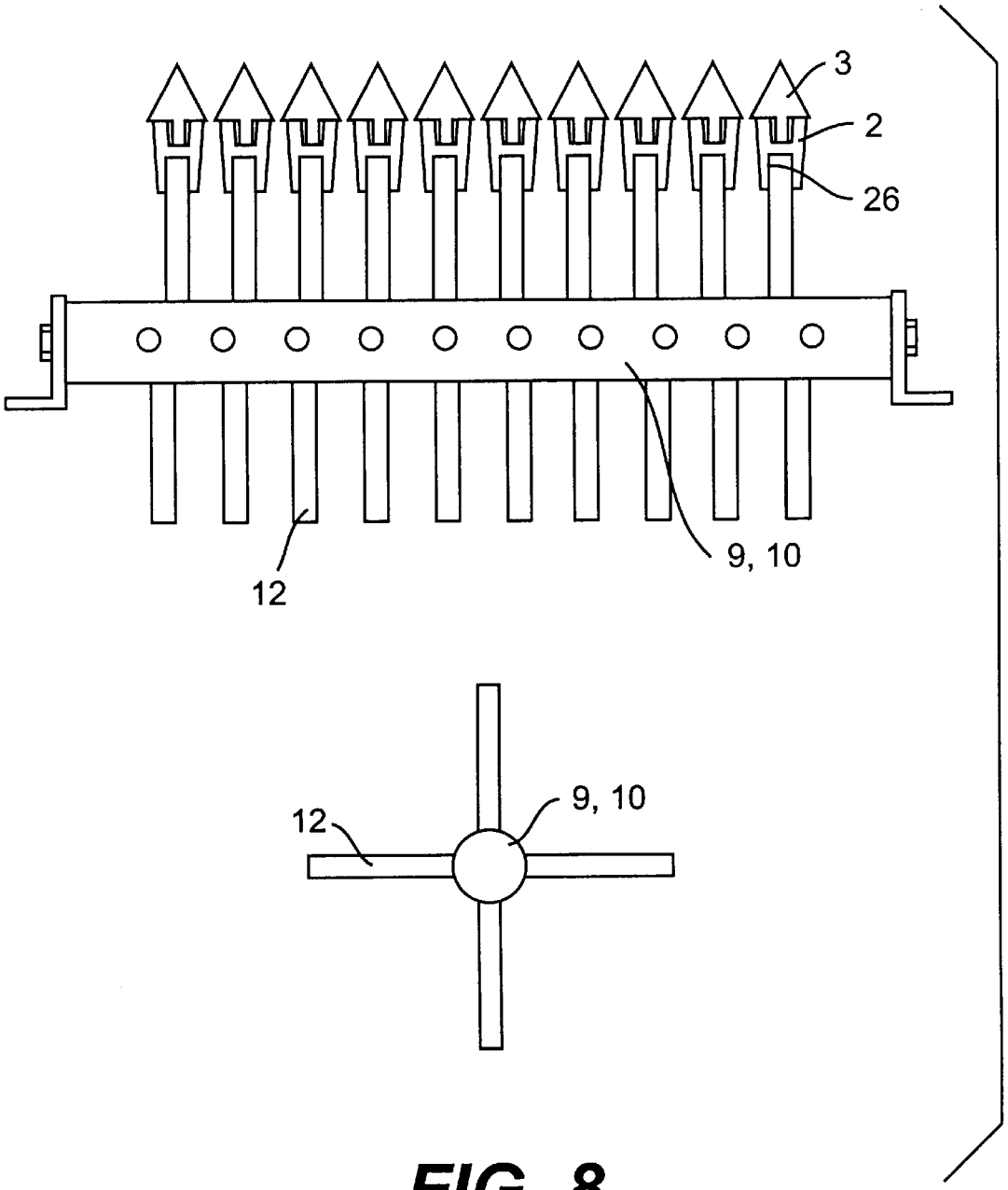

FIG. 8. Showing the setting pieces for setting the width of the gaps (in stages) on a light-construction machine.

Figure 9:
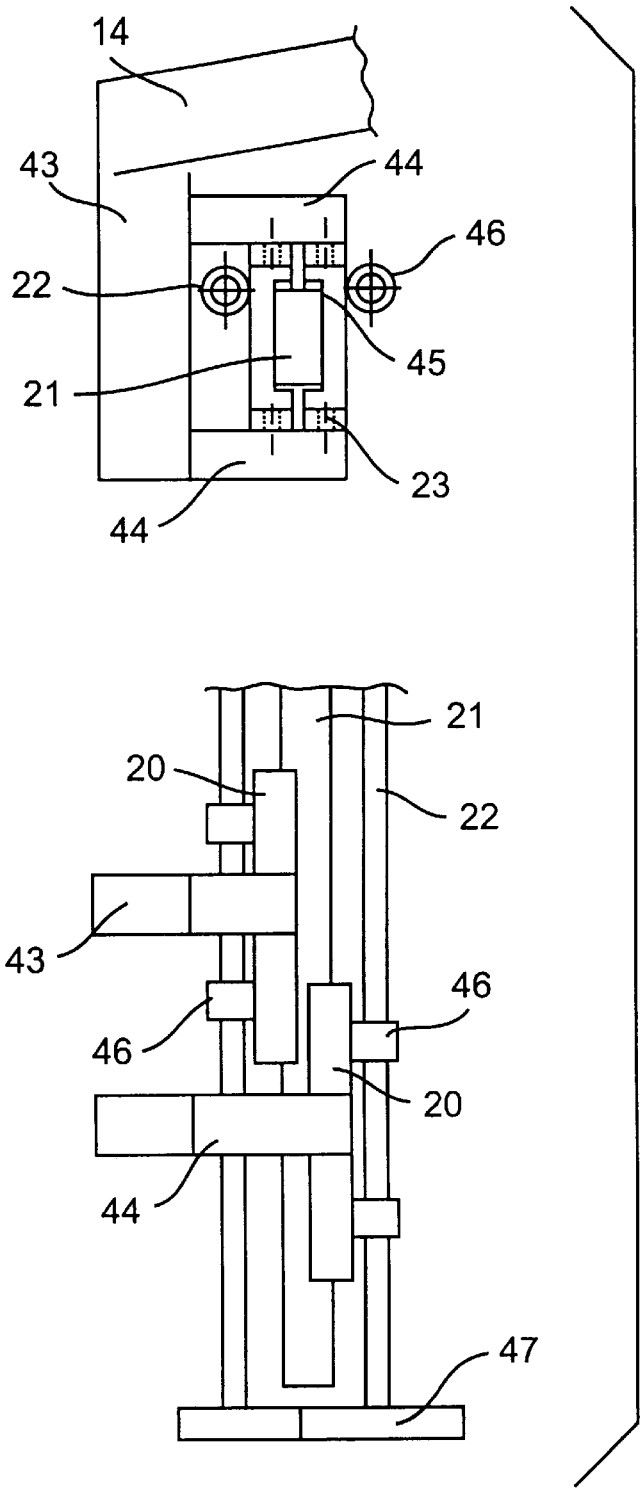

FIG. 9. Showing the setting equipment for a heavy-construction machine for grading large fish and heavy objects.

Figure 10:
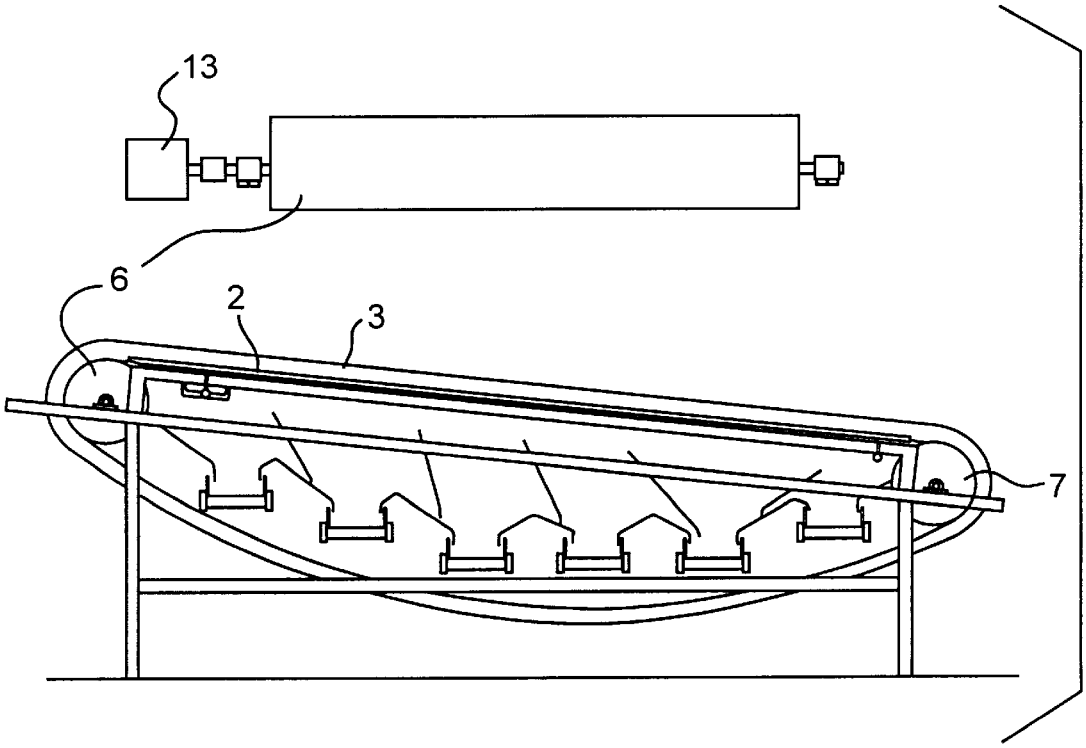

FIG. 10. Showing the drive equipment for a light-construction machine for grading small fish species and light objects.

Figure 11:
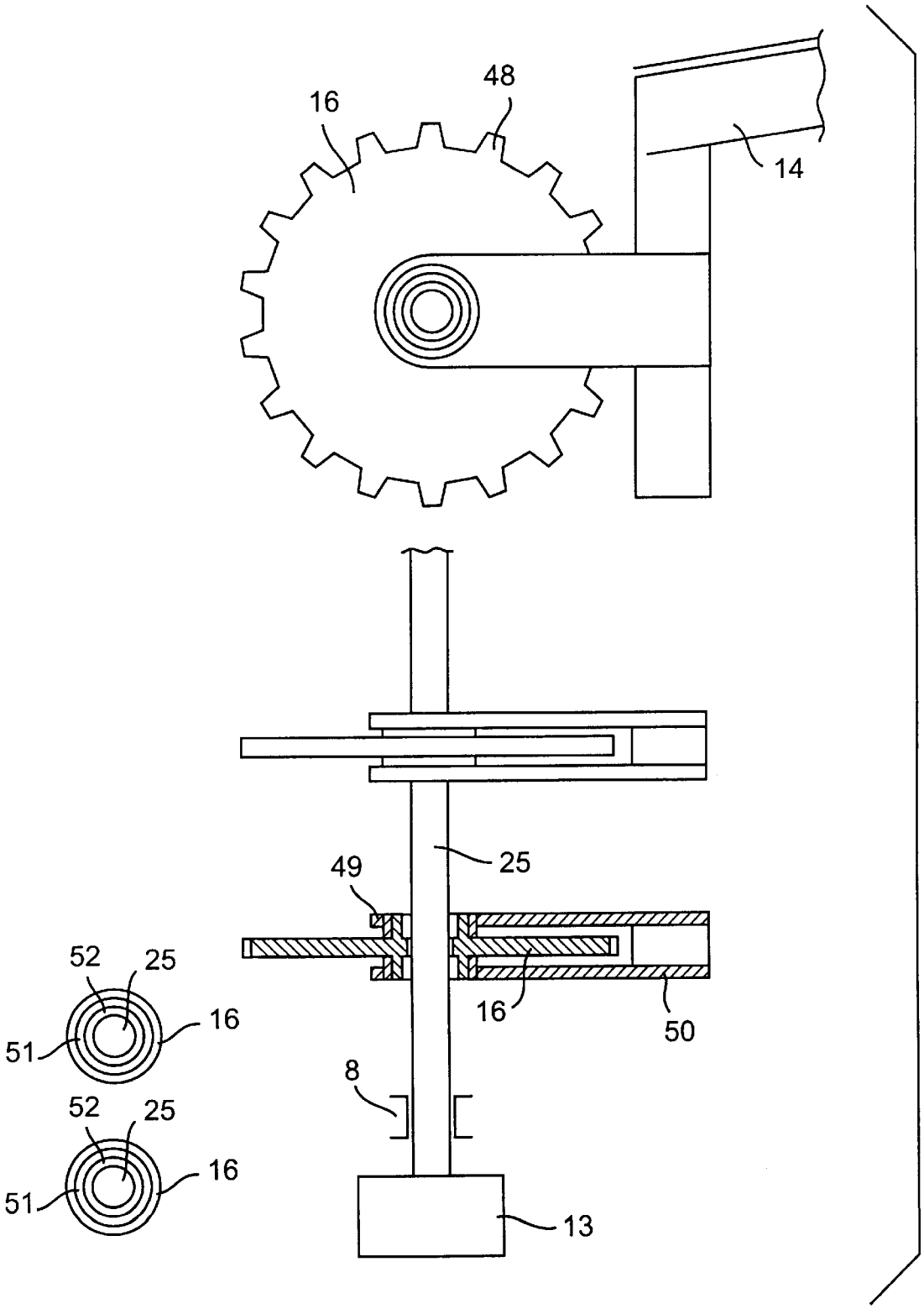

FIG. 11. Showing the drive equipment for a heavy-construction machine for grading large fish and heavy objects.

Figure 12:
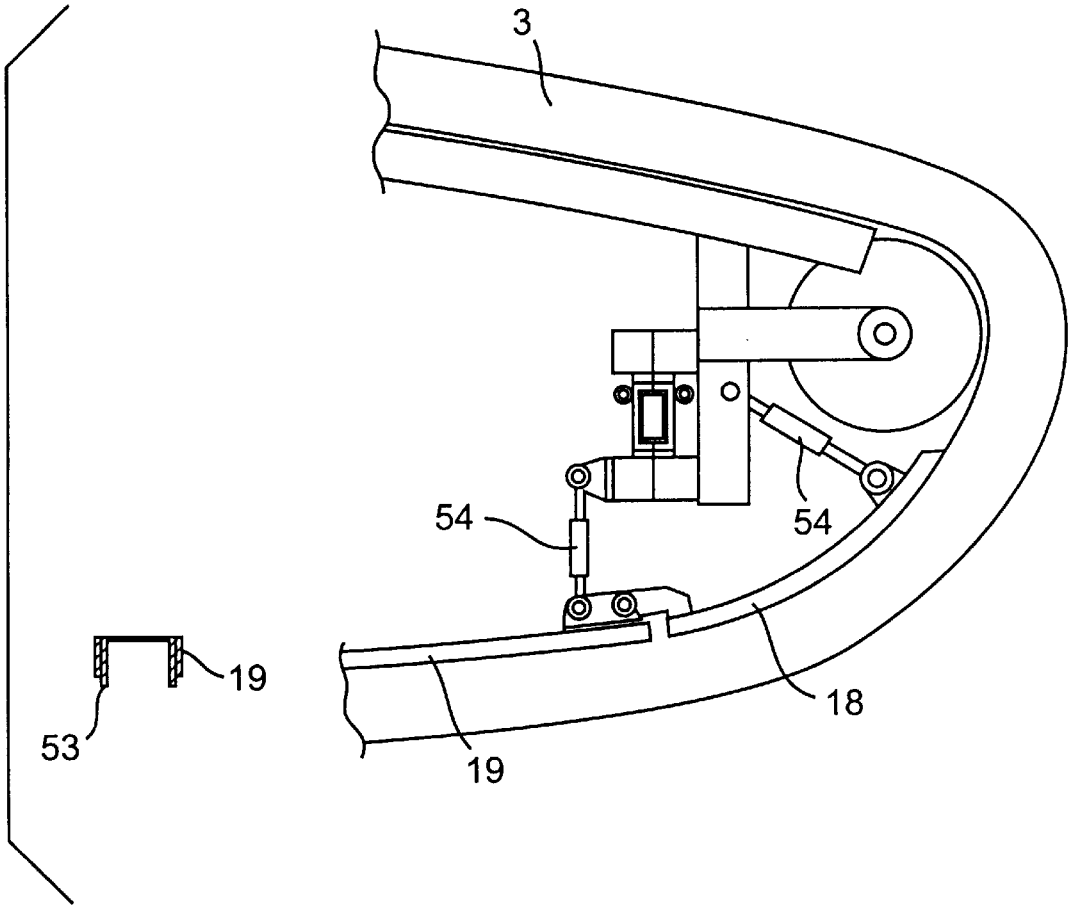

FIG. 12. Showing the tensioning equipment and anti-play equipment for heavy-construction grading machines.

Figure 13:
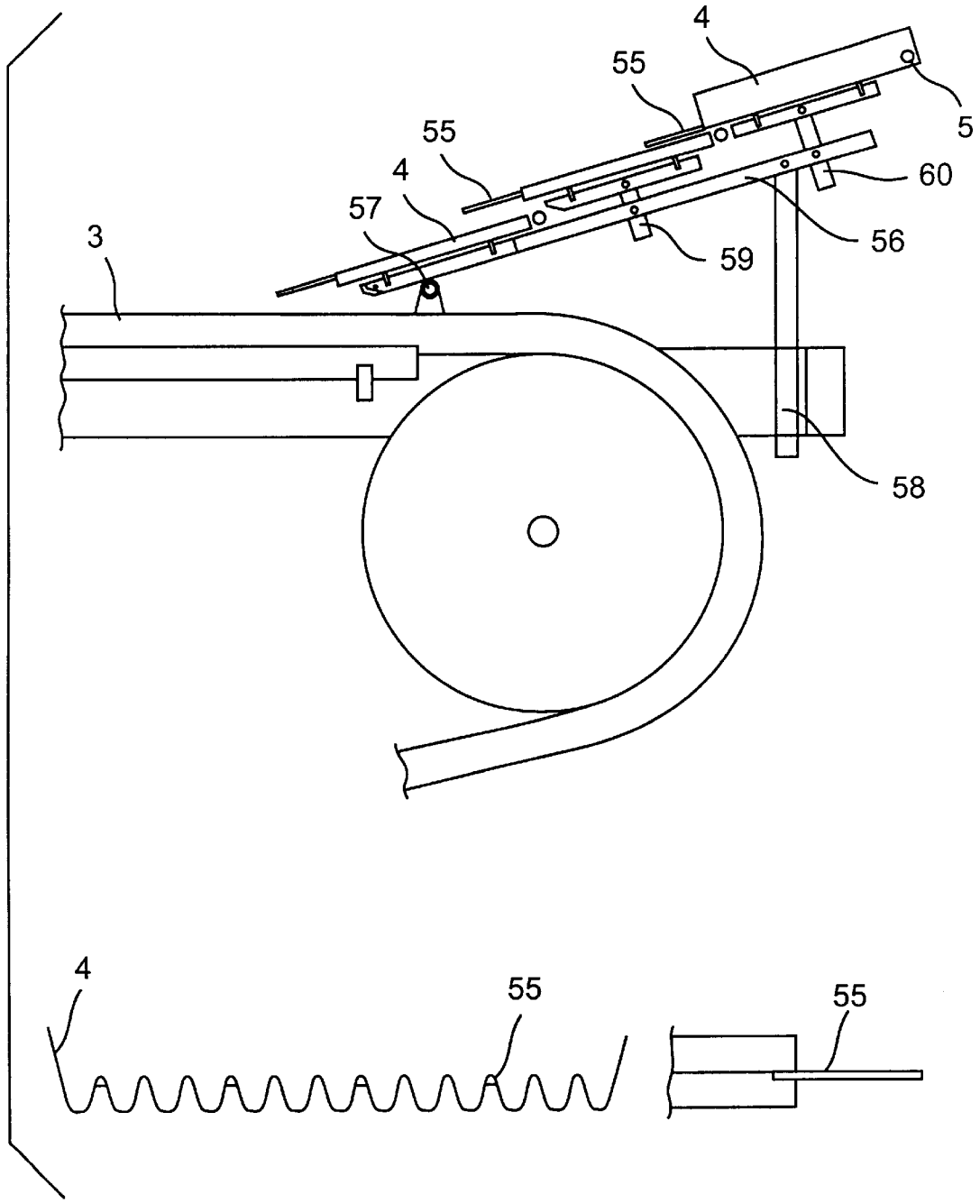

FIG. 13. Showing infeed and distribution equipment for fish and other long objects.

FIG. 1 shows a side-view of the machine. The material to be graded is lifted up into the step-channel (4). As it slides downwards, it assumes the optimal position before sliding onto the ridge-belts (3). If the material is not adversely affected by contact with water, a water-pipe (5) is used to direct a film of water onto the step-channel, which makes the material quicker to assume the optimal position. The gradient of the step-channel (4) is set so that the speed of the material as it enters the grading gaps is as close as possible to the speed of the ridge-belts. The ridge-belts (3) run along belt-guides (2). The number of ridge-belts may be from 2 to over 30 according to the processing rate required of the grader. The guides are shown with an upward incline in the figure, but they may be horizontal or inclined downwards, depending on what is found suitable at any given time. Between the ridge-belts (3) are formed the grading gaps, the number of which is one fewer than the number of ridge-belts. The belt-guides (2) rest on the supports (9) and (10)

with the adjustment pins (12). There are slots in the bottom of the belt-guides, into which the pins are inserted, the interval between the sides of the slots and the pins being small. The number of the adjustment pins (12) on each of the supports (9) and (10) is one greater than the number of channels, and the interval between the pins determines the width of the grading gap above the support. Support (9) is situated at the output end of the machine, while support (10) is at the intake end. In the case of an extremely long machine, supports may be added beneath the belt guides. The interval between the pins (12) on support (9) is larger than between those on support (10), resulting in the grading gaps being wider at the output end than at the intake end. There are more rows of adjustment pins on each support, up to a total of six, each row having its own adjustment interval for the grading gaps. By turning the supports, another row of pins can be placed under the guide tracks, resulting in a change in the width of the grading gaps. The adjustment options thus consist of a series of steps, with moveable cross-plates (11) situated beneath the grading gaps to make precise divisions between the size categories. The ridge-belts (3) are driven by the drive drum (6), frictional resistance between the drum and the belts being sufficient to drive the belts; if it is not sufficient, e.g. in the case of long machines or heavy items, then the drum is covered with material with a high friction resistance or with pins which engage in the ridges and so drive them. Drum (7) is a free drum which guides the belts into the guide slots in the belt guides. The drums rest on four bearings (8).

FIG. 2 shows a light-construction grading machine seen from above, showing the motor (13) which drives the drive drum. It is desirable that the motor should be speed-adjustable, but whether it is a hydraulic motor or an electric motor is immaterial. A gear motor may be used after the machine has been set and the material to be graded is always of the same type.

FIG. 3 shows a side view of a heavy construction grading machine. This machine is considerably more powerful, and withstands greater loads, than the machine in FIGS. 1 and 2, which is designed for lighter material, but it operates according to the same principle. The ridge-belt guides (14) are made out of stronger material, and the wear surfaces are made considerably stronger. They are also curved so that the ridge belts lie firmly and more heavily on the wear surfaces of the belt guides and do not give under the lateral pressure of the material, even though this pressure is considerable. The ridges on the grading belt (15) are larger than on the machine shown in FIGS. 1 and 2, and it is more robustly constructed. The ridge-belts are driven by a cog-wheel (16) which engages with the links of the ridge-belt. A free cog-wheel (17) engages the ridge-belt as it leaves the belt-guides and guides it into the belt tensioning equipment (18) and the anti-play equipment (19). The tensioning equipment removes all slack from the belt, while the anti-play equipment stops the belts being knocked about, e.g. on board a ship at sea. The tensioning equipment and the anti-play equipment may be combined in a single unit. The adjustment equipment on a heavy-construction machine is considerably stronger than on the light-construction version shown in FIGS. 1 and 2, as it is designed for a wide range of grading categories for heavy material and for use in difficult conditions. Each track is equipped with a runner (20) which rests on the support (21) which holds up all the tracks of the machine; there may be many such tracks. The runner (20) has wear surfaces of low-friction material in order to facilitate the movement of the ridge-belt guides (14) when setting the grading intervals. The length of each runner (20) is such that the tracks rest solidly on the support (21) so that the grading interval is not upset by instability. The pressure of the grading belts (15) on the curved belt guides (14) also makes the runners (20) lie firmly on the support (21). On machines with a large number of grading gaps, there are a large number of belt tracks (14), one more than the number of gaps. The length of the runners (20) is too great to make to possible to close the machine if they are lined up in a single row on the support (21). However, by positioning the runners (20) on either side of the support, it is possible to displace them, in which case the channels can be screwed closer together; if this is done, the grading range of the channels becomes very great, extending from a closed channel up to 10–20 cm or more. When grading is performed in more categories, the grading gap must be wider at one end. Thus, the belt guides (14) must be set at an angle, but without this influencing the adjustment screws (22) and constraining them. The degree of displacement increases as the tracks are located further from the centre of the machine, and is very considerable on the outer tracks. In order to make this displacement of the tracks possible, the track (14) is connected to the runner (20) by means of the rotational equipment (23). The adjustment screws (22) are located both at the intake end and the output end of the machine so that it is possible to adjust the width of the grading gaps both at the intake and output ends. The adjustment screws (22) have a right-hand thread at one end and a left-hand thread at the other. On the same adjustment shaft there may be screws with different pitches and several sections of thread. On grading machines with two channels, there is one adjustment shaft on either side, but when there are more channels, e.g. 12, two adjustment screws (22) are needed on either side, with a drive in between them. As is stated above, the drive-wheel (16) drives the ridge-belts (15). The wheels (16) and (17) run in bearings attached to the appropriate track (14), which ensures that the alignment of the wheels is always the same as that of the grading machine. The drive axle (25) lies through the centre of the drive wheels (16) of all the tracks of the machine. The axle (25) rests on bearings at each end. The axle (25) is slightly loose in the wheel-holes, so that it is possible to set the drive wheels (16) at variable angles to the centre line of the axle (25). The axle (25) and the holes in the drive-wheels (16) are formed in such a way that the axle drives the wheels easily despite the tracks running in different alignments.

FIG. 4 shows the ridge-belt guide (2) for a light-construction machine for grading smaller fish species and relatively light material. The guides (2) are also shown in FIG. 1. They are made of H-sections with an adjustment recess (26) and a support recess (28). The H-section is made of strong material such as aluminium or another material with sufficient support strength and wear-resistance to maintain a straight form under the normal stresses resulting from the use of the machine. The guide channels in the straight guides (2) are deep and provide good support for the light ridges which run along the running surface (27). The outer sides of the H-section are inclined; thus, the grading gaps are slightly wider at the bottom so that the material falls off the sections even though it is soft or has stringy parts which tend to become entangled.

FIG. 5 shows a ridge-belt grader (14) for a heavy-construction machine for grading large fish species and relatively heavy material. The ridge-belt guides, which are curved, are also shown in FIG. 3. Curved guides have the advantage that the stress on the belt keeps the ridges pressed tightly against the track, which means that they withstand considerable lateral stress, e.g. from heavy pieces of fish, without becoming inclined. The guides (14) are made of sections of flat steel or flat aluminium (30), which are connected with joints (31). On the upper edge of the guide there is a wear- and control edge (29) made of nylon or another wear-resistant and low-friction material. The control gap (32) is formed between the control edges. It is accurately measured, with a narrow degree of leeway.

FIG. 6 shows ridge links (3) for a light-construction machine. They are joined to each other, forming a continuous ridge belt, or a sort of chain. The ridge links (3) are cast out of nylon, with a pivot (38) made of rust-resistant material. The ridge links having sloping sides (34) which guide the objects towards the grading gaps. The grading gaps are formed by the lower edges (35) of the ridge links. In the bottom of the ridges there is an accurate guide (36) which runs along the guide-slot of the track (see FIG. 4) (26). The degree of leeway, ensuring that the grading gaps have a high degree of accuracy. A recess (37) is moulded in the bottom of each ridge unit, into which a cog tooth fits when the ridge unit passes over the drive drum. The links described here may be made out of other substances, such as metals or various types of plastic.

FIG. 7 shows ridge links (15) for a heavy-construction machine. The ridge-belts (15) are formed by ridge links and connector links (41). These belts have larger ridges than the belts in FIG. 6, as they are intended for larger fish and heavier items. The ridge links (15) are moulded from sheet metal or another mouldable material. They have sloping sides (34) which end at the bottom of the grading edge (35). A guide ridge (40) extends downwards from the bottom of the ridge, and runs along the guide-slot of the track (32) (cf. FIG. 5). The grading gap (42) is formed between two ridge links. It determines the thickness of the objects which fall down. These ridge links may be made of other materials, such as nylon or plastic, if this is considered economically attractive. The connector link (41) is made of strong and wear-resistant material such as steel or nylon.

FIG. 8 shows the setting- and support pieces (9) and (10) in a light-construction machine (cf. also FIG. 1), which hold up the grading channels. The setting- and support pieces (9) and (10) are made of a reliable metal, and are sufficiently massive so as to have negligible elasticity, in addition to which they are thick enough for it to be possible to screw support and guide pins (12) into them from several sides. The support pins (12) which are in use at any given time point upwards, and the track guides (2) rest on them. On each setting- and support piece it is possible, e.g., to have 4–6 rows of guide pins (12), with a different interval between the pins in each row. When the setting and support pieces (9) and (10) are turned, a new row of support and guide pins is brought underneath the track guides (2) (cf. FIG. 1), thus altering the interval. The support and guide pins (12) extend up into the slots (26) in the bottom of three tracks (2). The interval between the width of the slot (26) and the diameter of the support and guide pins (12) is so small that the track is held securely in place and the accuracy of the measurement of the grading gap is very high. With this setting equipment it is possible to have a great number of channels, if desired, e.g. as many as 40, with a correspondingly high processing rate.

The setting options available with the setting pins consist of a series of steps. More accurate settings are made on these machines by the use of cross-plates. By combining settings using the setting pins and the cross-plates (11) (cf. FIG. 1), the precision of the size categories can be measured in fractions of a millimeter.

FIG. 9 shows the setting equipment for a heaving-construction grading machine. The track guide (14) is held up by a support (43). Arms for the rotational equipment (44) extend out from the support, and from them extend the rotational plugs (23) which engage in bearings in the runners (20), which in turn rest on the support piece (21). When grading is performed in more than one size category, the grading gap must be wider at one end than the other. Thus, the tracks (14) must be set at an angle, without this having an influence on the adjustment screws (22) and putting pressure on them. The further the tracks are away from the centre of the machine, the greater the angle of divergence must be; this problem is solved by means of the rotational equipment. There may be a considerable number of runners (20) in machines with many tracks. In order to facilitate the shifting of the tracks when setting the grading gap, the wear surface (45) on the runner is made of low-friction material. The length of the runner (20) is sufficient so that the tracks rest constantly on the support piece (21) to make sure that the grading gap will not be influenced by instability. By positioning runners (20) on either side of the support piece (21), it is possible to screw the channels closer together and make the grading range of the channels very great, extending from a closed channel up to 10–20 cm or more. The adjustment screws (22), which are located at both the intake and output end of the channel, go through the adjustment nuts (46), which are attached to the runner (20) to enable the width of the grading gap to be adjusted both at the intake and the output end. The adjustment screws (22) move the track guides, which are situated on each side of the centre of the machine, towards or away from the centre; for this reason they have right-hand thread on one end and left-hand thread on the other. On the same adjustment shaft (22) there may be screws with different pitches and several sections of thread when there is a large number of grading channels. On grading machines with two channels, there is one adjustment shaft on each side, but when the number of channels is greater, e.g. 12, there must be two adjustment shafts on each side with the drive (47) in between. The aforementioned parts are made of high-quality material such as aluminium, stainless steel or nylon, while other materials may be selected if they are more economically viable.

FIG. 10 shows a light-construction machine with a drum drive. The drive drum (6) pulls the grading belts (3) with the grading ridges along the track-guides (2). The drive drum (6) is fitted with teeth to ensure that the belts are pulled forward at the speed intended, or else are smooth but are covered with a gripping material which provides sufficient resistance so that the belts (3) do not slip. The free drum (7) guides the grading ridges (3) into the belt-guide (2) so that they run smoothly. A speed-controllable electric or hydraulic motor (13) is connected to the axle of the drive drum. The speed of the grading ridges (3) is controlled by means of the motor so that it is as near as possible to the speed of the raw material when it slides into the machine. The machine may be driven by a gear motor, in which case it would be selected with reference to the average speed, but this option is not recommended.

FIG. 11 shows the drive equipment of a heavy-construction machine. The drive wheels (16) in FIG. 3 drive the belts with the grading ridges. Teeth (48) are moulded into the drive wheel (16), and they engage with the connecting links (41) (cf. FIG. 7). The wheels rotate in bearings (49) which are in arms (50) attached to the appropriate track equipment (14), so ensuring that the alignment of the wheels is always the same as that of the grading belt. In the centre of the wheel there is a hole for the drive axle (25), with moulded slots or grooves (51) with which the drive equipment of the axle engages. The wheels are made of a reliable material such as nylon, stainless steel or other substances suitable for moulding cog wheels. The drive axle (25) runs through the center of the drive wheels of all the tracks of the machine. The axle rests on bearings (8) at each end. The axle is slightly loose in the holes, so it is possible to set the drive wheels at varying angles to the centre line of the axle. There is fluting, or there are wedges (52) on the axle which engage with grooves in the drive wheels and pull them. Alternatively, the axle could be made with an edged section (25), e.g. square in section, in which case wedges would not be necessary. The axle is driven by a speed-controllable electric or hydraulic motor (13). A gear motor may also be used, but this is not a desirable solution. A free wheel (17) is situated at the other end of the machine (cf. FIG. 3). The free wheel is equipped with the same sort of teeth as the drive wheel, and guides the grading belt (15) (cf. FIG. 3) from the guides and towards the tensioning and anti-play equipment (14, 18 and 19) (cf. FIG. 3).

FIG. 12 shows the tensioning and anti-play equipment, which removes slack from the ridge belts (3) (cf. FIG. 3) and ensures that there is not lateral play on the slack part of the belt. The equipment is made out of a U-shaped section (53) with hard-wearing, low-friction edges to reduce resistance. If it is found desirable, the tensioning (18) and anti-play equipment (19) may be combined in a single unit or divided up into several parts (on the diagram it is shown in two parts). The tensioning and anti-play equipment is constructed in a curved shape (catenary). By means of the tensioning screw or screws (54), it is possible to press the anti-play and tensioning tracks downwards and tension each belt in the machine independently of all the others. The anti-play tracks (19) support the lower part of the grading belts and prevent them from being knocked about, which is important, e.g. when the machine is used on board ship.

FIG. 13 shows the intake channel for fish or other long objects which are to be graded by thickness. The intake channel (4) consists of two or more steps. Three are shown in the figure. The uppermost step consists of a smooth pan which receives the material from the conveyor device. The material becomes dispersed on the pan, and if it is not adversely affected by water, a water film is formed on the pan by a water spray from the water-pipe (5). There are alignment pins (55) on the front edge of the pan which align the material which slides down the pan, the interval between the pins being determined by the type and size of the objects. After the smooth pan, the next pans have corrugated surfaces, the spacing of the corrugation channels corresponding to the positioning of the grading gaps in the intake of the machine. There are also water-pipes (5) on the corrugated pans for use if the material to be graded is not adversely affected by water. There are also alignment pins (55) on the edges of the corrugated pans which align any objects which may have arrived with a transverse orientation after passing the previous alignment pins. The overall gradient angle of the intake channel is adjusted by altering the angle of the support pieces (56), which turn about a pivot (57), and the height is adjusted by means of the adjustment bars (58). The upper steps of the channel may be adjusted separately by means of the adjusters (59) and (60). The alignment pins (55), the corrugations in the lower intake pans and the smooth pan at the top of the intake channel, together with the water-sprays (5), are intended to align the objects correctly and direct them towards the machine's grading gaps. The gradient of the channel (4) and the setting of the water spray, where it is used, determine the speed of movement of the material and are used in order to made it the same as the speed of the grading ridges (3).

What is claimed is:

1. Apparatus for grading sensitive products, comprising an in-feed device, ridge-belts for moving and grading the products, and guide rails for guiding the ridge-belts, the ridge-belts comprising a plurality of units, triangular in cross section, and connected to form endless belts guided by the guide rails from the in-feed device to remote end, the ridge-belts being spaced from each other on the guide rails so that spacing of the ridge-belts is greater at the remote end than at the in-feed device, the apparatus further comprising a setting mechanism for adjusting the distance between individual guide rails, grading compartments under the ridge-belts, and a drive mechanism, whereby, in use, the products to be graded are fed onto the in-feed device and directed onto the ridge-belts that move and grade the products according to thickness into the appropriate grading compartments, wherein the in-feed device comprises at least one adjustable step for directing the products onto the ridge-belts so that the velocity of the products is controlled and orientation of the products is adjusted, and wherein the guide rails for the ridge-belts have downwardly open slots into which support members of the setting mechanism extend, the position of the support members being settable by the setting mechanism to determine the distance between the ridge-belts.

2. Apparatus as claimed in claim 1, wherein the in-feed device comprises two or more steps each having an adjustable slope.

3. Apparatus as claimed in claim 1 or 2, wherein each step comprises a corrugated surface to guide the products to be graded.

4. Apparatus as claimed in claim 3, including alignment pins at the downstream end of the at least one step for directing the products into an adjusted position.

5. Apparatus as claimed in claim 3, comprising means for directing a controllable water flow onto the at least one step of the in-feed device.

6. Apparatus as claimed in claim 1, wherein the guide rails are of H-shaped cross section to provide upwardly facing guiding slots, the ridge-belts extending into the guiding slots.

7. Apparatus as claimed in claim 6, further comprising one or more turnable supporting beams having supporting/setting pins extending into the downwardly open slots in the guide rails to determine the distance between the guide rails and the ridge-belts.

8. Apparatus as claimed in claim 7, wherein the supporting/setting pins extend radially from the supporting beams to form parallel rows of pins, and wherein the supporting beam is turnable to select one of the rows so that is pins extend into the lower slots in the guide rails, whereby the spacing between the pins in the selected one row determine the distance between the guide ails and the ridge-belts.

9. Apparatus as claimed in claim 8, wherein a predetermined distance between the support/settings pins in each row on the supporting beams determines the distance between the individual ridge-belts.

* * * * *